US011202934B2

(12) United States Patent
Kim et al.

(10) Patent No.: US 11,202,934 B2
(45) Date of Patent: Dec. 21, 2021

(54) UPPER AND LOWER LIMB WALKING REHABILITATION DEVICE

(71) Applicant: Hyeong Sic Kim, Seoul (KR)

(72) Inventors: Hyeong Sic Kim, Seoul (KR); Jung Yup Kim, Seoul (KR); Jeong Woo Seo, Chungju-si (KR); Do Hoon Koo, Gwangju (KR); Hyun Ju Park, Seoul (KR)

(73) Assignee: Hyeong Sic Kim, Seoul (KR)

( * ) Notice: Subject to any disclaimer, the term of this patent is extended or adjusted under 35 U.S.C. 154(b) by 0 days.

(21) Appl. No.: 16/967,121

(22) PCT Filed: Jan. 7, 2019

(86) PCT No.: PCT/KR2019/000178
§ 371 (c)(1),
(2) Date: Aug. 3, 2020

(87) PCT Pub. No.: WO2019/151663
PCT Pub. Date: Aug. 8, 2019

(65) Prior Publication Data

US 2020/0353308 A1 Nov. 12, 2020

(30) Foreign Application Priority Data

Feb. 5, 2018 (KR) ..... 10-2018-0014022

(51) Int. Cl.
*A63B 22/00* (2006.01)
*A63B 21/00* (2006.01)
(Continued)

(52) U.S. Cl.
CPC ..... *A63B 22/0012* (2013.01); *A61H 3/008* (2013.01); *A63B 21/4017* (2015.10);
(Continued)

(58) Field of Classification Search
CPC ..... A63B 22/0012; A63B 21/4017; A63B 21/4034; A63B 22/02; A63B 2209/08;
(Continued)

(56) References Cited

U.S. PATENT DOCUMENTS 4,620,703 A * 11/1986 Greenhut ..... A63B 21/0056 482/114
4,635,875 A * 1/1987 Apple ..... B66D 1/36 242/155 BW
(Continued)

FOREIGN PATENT DOCUMENTS

CN 106955217 A 7/2017
KR 1020120083778 A 7/2012
(Continued)

*Primary Examiner* — Garrett K Atkinson
(74) *Attorney, Agent, or Firm* — Rabin & Berdo, P.C.

(57) ABSTRACT

An upper and lower limbs walking rehabilitation device of the present invention includes a foot stepping part, and comprises: a lower frame part; a lower limb link unit provided between the foot stepping part and the lower frame part and providing a walking trajectory to the foot stepping part; an upper frame part detachably provided at the upper end of the lower frame part by means of a detachment part; an upper limb link unit provided at the upper frame part and implementing the movement of upper limbs; and an upper linking part for linking the upper limb link unit and the lower limb link unit.

9 Claims, 6 Drawing Sheets

(51) Int. Cl.
*A61H 3/00* (2006.01)
*A63B 22/02* (2006.01)

(52) U.S. Cl.
CPC ..... *A63B 21/4034* (2015.10); *A63B 22/02* (2013.01); *A61H 2201/1652* (2013.01); *A63B 2209/08* (2013.01); *A63B 2225/093* (2013.01)

(58) Field of Classification Search
CPC ..... A63B 2225/093; A63B 2208/0285; A63B 2209/10; A63B 21/00178; A63B 21/00181; A63B 69/0062; A63B 69/0059; A63B 2071/0072; A63B 22/025; A63B 23/03516; A63B 2022/0094; A63B 21/153; A63B 24/0087; A63B 22/0235; A61H 3/008; A61H 2201/1652; A61H 1/0274; A61H 1/0262; A61H 1/0229; A61H 2203/0406; A61H 2201/1642; A61H 2201/1261; A61H 2201/0192; A61H 2001/0211; A61H 2201/0107; A61H 2201/1638; A61H 1/00; A61H 1/024; A61H 2003/007; A61H 1/0255; A61H 2201/12; A61H 2201/164; A61H 3/00; B66D 1/505; B66D 1/12; B66D 1/36; B66D 1/28
See application file for complete search history.

(56) References Cited

U.S. PATENT DOCUMENTS 4,724,827 A * 2/1988 Schenck ..... A61H 1/0288 601/40
5,667,461 A * 9/1997 Hall ..... A61H 1/0229 472/15
6,123,649 A * 9/2000 Lee ..... A63B 21/153 482/51
6,146,315 A * 11/2000 Schonenberger ..... A63B 22/02 482/69
6,666,831 B1 * 12/2003 Edgerton ..... A61H 1/0237 600/587
6,689,075 B2 * 2/2004 West ..... A61F 5/0102 482/69
6,796,926 B2 * 9/2004 Reinkensmeyer ... A61B 5/1038 482/51
6,821,233 B1 * 11/2004 Colombo ..... A61F 5/0102 482/54
7,331,906 B2 * 2/2008 He ..... A61H 1/0237 482/69
7,494,450 B2 * 2/2009 Solomon ..... A61H 1/0229 482/51
7,887,471 B2 * 2/2011 McSorley ..... A63B 23/0355 482/138
7,998,040 B2 * 8/2011 Kram ..... A63B 21/4013 482/124
8,057,410 B2 * 11/2011 Angold ..... A61H 3/008 601/5
8,608,479 B2 * 12/2013 Liu ..... A61H 3/008 434/255
8,920,347 B2 * 12/2014 Bayerlein ..... A63B 21/00181 601/35
9,638,163 B2 * 5/2017 Holloway ..... B66C 1/66
9,789,023 B1 * 10/2017 Lee ..... A63B 24/0021
9,981,157 B2 * 5/2018 Bayerlein ..... A63B 22/0235
10,278,883 B2 * 5/2019 Walsh ..... A61H 1/0244
10,342,461 B2 * 7/2019 Basta ..... A61B 5/1038
10,465,663 B2 * 11/2019 Holloway ..... B66C 13/08
10,925,796 B2 * 2/2021 Fukunaga ..... A61H 1/0229
2003/0064869 A1 * 4/2003 Reinkensmeyer ..... A61H 3/008 482/100
2004/0097330 A1 * 5/2004 Edgerton ..... A61H 1/0262 482/1
2005/0101448 A1 * 5/2005 He ..... A63B 22/02 482/54
2008/0255488 A1 * 10/2008 Agrawal ..... A63B 69/0064 602/23
2008/0300118 A1 * 12/2008 Wehrell ..... A63B 23/047 482/129
2010/0285929 A1 * 11/2010 Bayerlein ..... A63B 21/00181 482/54
2012/0004581 A1 * 1/2012 Dinon ..... A61H 1/0255 601/23
2013/0225371 A1 * 8/2013 Harrer ..... A63B 21/16 482/8
2014/0121071 A1 * 5/2014 Strom ..... A63B 21/156 482/99
2015/0232307 A1 * 8/2015 Holloway ..... F03D 80/50 414/800
2017/0218927 A1 * 8/2017 Holloway ..... B66C 1/108

FOREIGN PATENT DOCUMENTS

KR 101289005 B1 7/2013
KR 20160069192 A 6/2016
KR 101661465 B1 10/2016
KR 101790048 B1 10/2017

* cited by examiner ( a )

( b )

(a)

(b)

UPPER AND LOWER LIMB WALKING REHABILITATION DEVICE

TECHNICAL FIELD

The present disclosure relates to a walking rehabilitation device.

BACKGROUND ART

In walking training and rehabilitation, the movements of the skeleton and contraction and relax of muscles in a normal range of motion of the body are the most important factors for strengthening and restoring intrinsic functions. The gait rehabilitation market for the devices to restore walking function to the normal range of motion is rapidly growing, and with this trend, demand is on the rise for the development of low-cost walking rehabilitation devices, which are both economic and highly effective in rehabilitation so as to be widely applied in walking rehabilitation.

As a conventional technique, a treadmill-based walking rehabilitation device disclosed in Korean Patent Publication No. 10-1790048 filed by and granted to the present Applicant relates to a treadmill-based walking rehabilitation device including a foot stepping part as shown in FIGS. 1 and 2 accompanying the present disclosure, which includes: a frame part including a horizontal support and vertical supports disposed vertically on both sides of the horizontal support; a link unit provided between the foot stepping part and the vertical supports and providing a walking trajectory to the foot stepping part; a treadmill belt provided at the horizontal support and in contact with the foot stepping part so as to be moved together with the foot stepping part; and a linking part linking the link unit with the treadmill belt.

However, since the conventional technology described above provides a technical configuration mainly focused on rehabilitation of the lower limb by means of the foot stepping part, the link unit, and the like, while it may be used for those in need of lower limb rehabilitation, such as elderly people, patients with artificial joint surgery, and people with chronic lower limb hemiplegia, there is a problem that it cannot be used for the disabled person or patients who are in higher need of upper limb rehabilitation or trunk rehabilitation, such as those with subacute hemiplegic disorder who need rehabilitation-combined treatment or those with injured cervical spines. Accordingly, since the consumers are required to purchase rehabilitation devices for lower limbs and rehabilitation device for upper limbs respectively, there is a problem in that the consumers are burdened with the doubled purchase cost of the rehabilitation devices.

DISCLOSURE

Technical Problem

An object of the present disclosure is to provide an upper and lower limbs walking rehabilitation device capable of performing both rehabilitation of the lower limbs and rehabilitation of the upper and lower limbs.

Another object of the present disclosure is to provide an upper and lower limbs walking rehabilitation device capable of implementing natural arm swing movements of the upper limb similar to those generated during normal walking.

Technical Solution

In order to achieve the objectives mentioned above, an upper and lower limbs walking rehabilitation device according to an embodiment of the present disclosure includes a foot stepping part, and includes: a lower frame part; a lower limb link unit provided between the foot stepping part and the lower frame part and providing a walking trajectory to the foot stepping part; an upper frame part detachably provided at the upper end of the lower frame part by means of a detachment part; an upper limb link unit provided at the upper frame part and implementing the movement of upper limbs; and an upper linking part for linking the upper limb link unit and the lower limb link unit.

The detachment part may include an insertion protrusion provided on a lower end of the upper frame part; and an insertion groove formed in an upper end of the lower frame part to receive the insertion protrusions inserted therein.

The upper limb link unit may include: a first upper limb link member having one end provided at the upper frame part so as to be pivotable by a first upper limb hinge; a second upper limb link member having one end provided at the other end of the first upper limb link member so as to be pivotable by a second upper limb hinge; a third upper limb link member having a central portion provided at the other end of the second upper limb link member so as to be pivotable by a third upper limb hinge, and one end provided at an upper part of the upper frame part so as to be pivotable by a fourth upper limb hinge, thereby moving the third upper limb hinge along an arc while supporting a load; a fourth upper limb link member having one end provided at the other end of the third upper limb link member so as to be pivotable by a fifth upper limb hinge; and a handle provided at the other end of the fourth upper limb link member.

Advantageous Effects

According to an embodiment of the present disclosure, a technical configuration is provided, which includes a foot stepping part, a lower frame part, a lower limb link unit, an upper frame part, an upper limb link unit, and an upper linking part, and in which the lower frame part and the upper frame part are provided so as to be attachable and detachable to and from each other by means of a detachment part, thereby providing a combination of rehabilitation for lower limb and rehabilitation for upper and lower limbs. That is, rehabilitation mainly focused on the lower limb can be provided by detaching the upper frame part from the lower frame part, or rehabilitation for both the lower and the upper limbs can be provided by attaching the upper frame part to the lower frame part. Particularly, the burden on the installation space of the device and the cost of purchasing the device can be minimized, because only one upper and lower limbs walking rehabilitation device of the present disclosure can be purchased and used according to the improvement of the degree of disability, that is, the upper frame part may be initially attached to the lower frame part to enable rehabilitation of both the upper and lower limbs, and as the degree of disability improves, the upper frame part may be detached to enable rehabilitation of the lower limb.

BEST MODE FOR INVENTION

Figure 1:
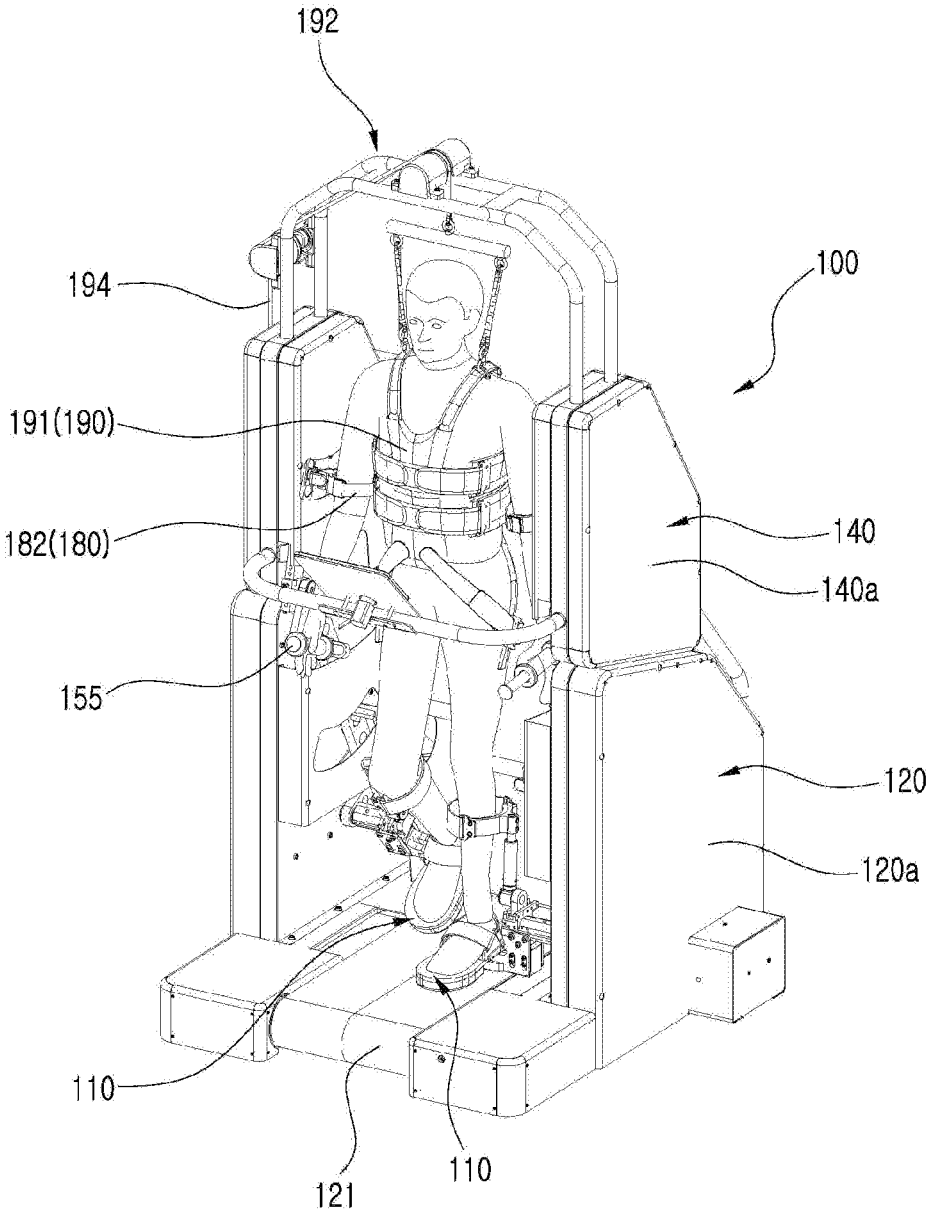
FIG. 1 is a perspective view schematically showing an upper and lower limbs walking rehabilitation device according to an embodiment of the present disclosure.

An upper and lower limbs walking rehabilitation device 100 according to an embodiment of the present disclosure may include a foot stepping part 110, a lower frame part 120, a lower limb link unit 130, an upper frame part 140, an upper limb link unit 150, and an upper linking part 160, as shown in FIGS. 1 to 6. Hereinafter, each of the components will be described in detail with continued reference to FIGS. 1 to 6.

The foot stepping part 110 is where the user's foot is placed and fixed in position, as shown in FIG. 1. For example, the foot stepping part 110 may include a foot stepping plate contacting the sole of the user's foot and a foot fixing part including a band or the like for fixing the user's foot.

Further, although not shown, the foot stepping part 110 may be provided to be movable forward and backward with respect to a third link member 133 to be described below.

Figure 2:
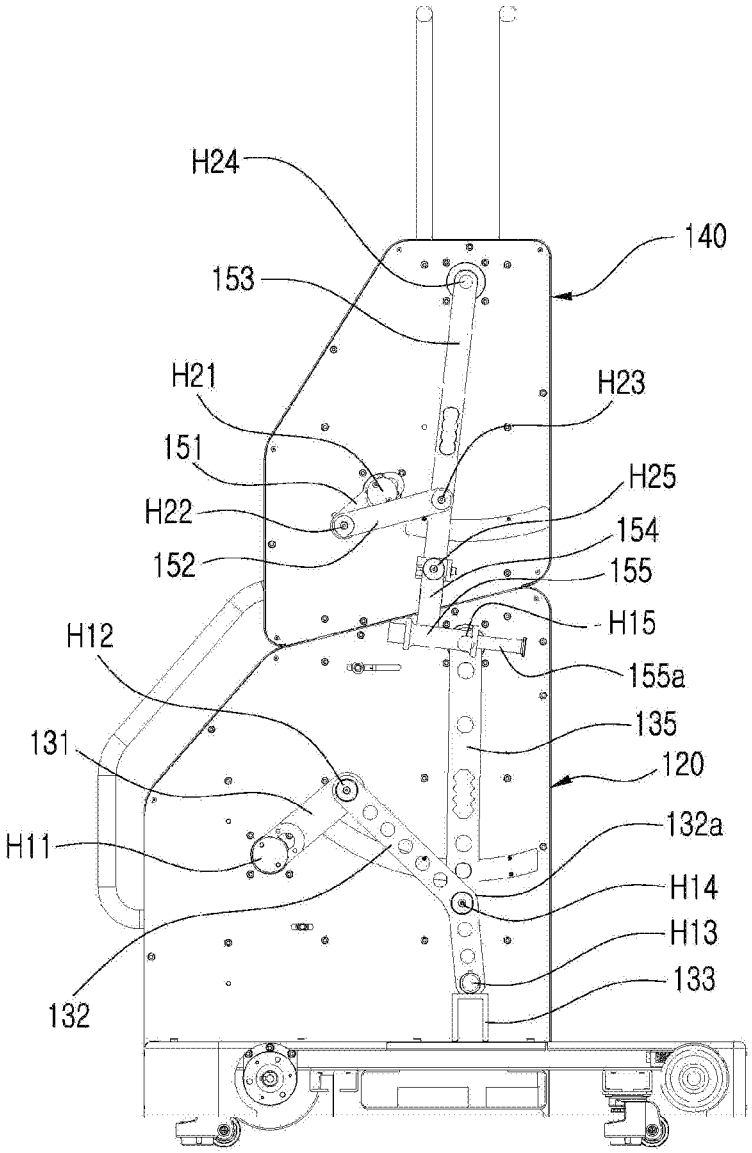
FIG. 2 is a view schematically showing an upper limb link unit and a lower limb link unit provided in the upper support and lower support of the upper and lower limbs walking rehabilitation device of FIG. 1, respectively.
Figure 3:
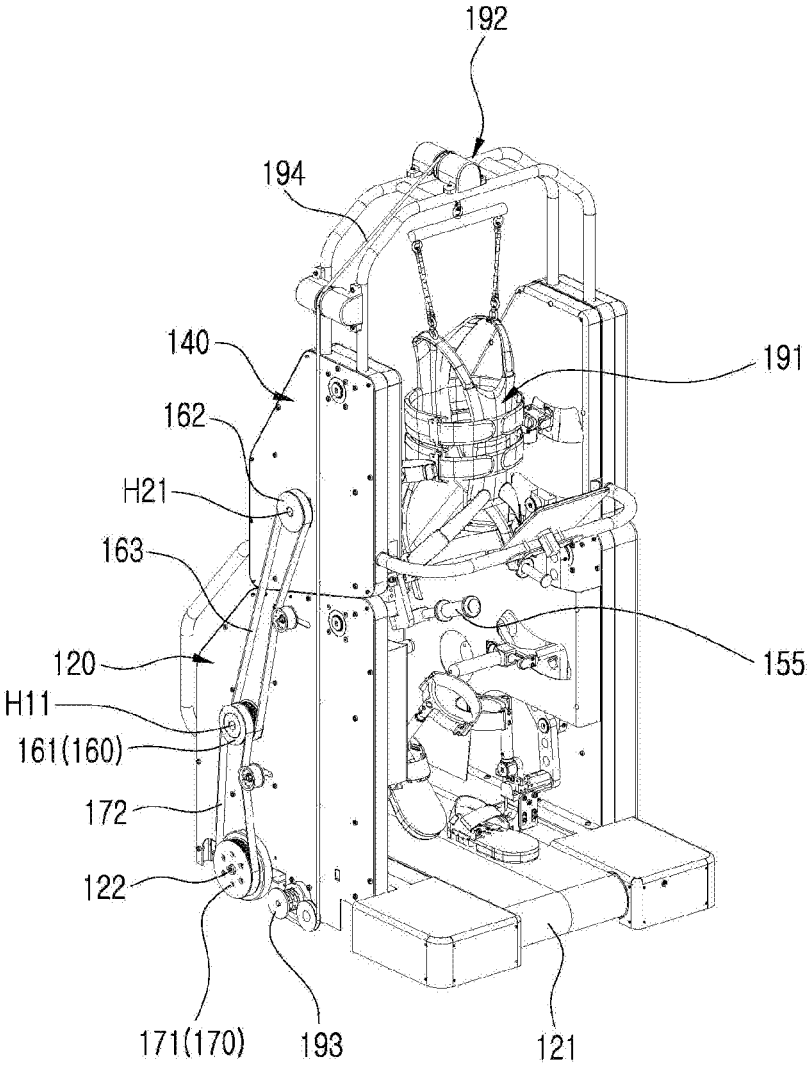
FIG. 3 is a view schematically showing an upper linking part, a lower linking part, and an upper limb supporting part of the upper and lower limbs walking rehabilitation device of FIG. 1.

As shown in FIGS. 1 to 3, the lower frame part 120 is a component that serves as a lower frame of the upper and lower limbs walking rehabilitation device 100 of the present disclosure, and may be covered by a lower outer cover (120*a* in FIG. 1) for safety.

Furthermore, as shown in FIG. 3, a treadmill belt 121 may be rotatably provided at the lower frame part 120 so as to be rotated with a belt rotation shaft 122. The treadmill belt 121 is where the foot stepping part 110 is brought into contact, and is a component that is moved together with the foot stepping part 110 when the foot stepping part 110 is in contact therewith. For example, as shown in FIG. 1, the treadmill belt 121 may include a wide and flat contact surface to be contacted by the foot stepping part 110. In addition, the treadmill belt 121 may have a closed loop shape with both ends connected to each other. In particular, since the foot stepping part 110 is in contact with the treadmill belt 121 having a relatively wide contact surface, focused walking rehabilitation training can be provided, and since the flat contact surface is provided by the treadmill belt 121, the walking rehabilitation training can be provided, by which walking is similar to walking on actual ground without having increased speed at the time of stepping.

The lower limb link unit 130 is a component that provides a walking trajectory to the foot stepping part 110, and may be provided between the foot stepping part 110 and the lower frame part 120, as shown in FIGS. 1 and 2.

For example, as shown in FIG. 2, the lower limb link unit 130 may include a first lower limb link member 131, a second lower limb link member 132, a third lower limb link member 133 and a fourth lower limb link member 134.

The first lower limb link member 131 may have one end provided at the lower frame part 120 so as to be pivotable by means of a first lower limb hinge H11. The second lower limb link member 132 may have a bent shape having a bending part 132*a* formed at its central portion, and one end of the second lower limb link member 132 may be provided at the other end of the first lower limb link member 131 so as to be pivotable by means of the second lower limb hinge H12. One end of the third lower limb link member 133 may be provided at the other end of the second lower limb link member 132 so as to be pivotable by means of the third lower limb hinge H13, and the other end of the third lower limb link member 133 may be provided at the foot stepping part 110. One end of the fourth lower limb link member 134 may be provided at the bending part 132*a* of the second lower limb link member 132 so as to be pivotable by means of the fourth lower limb hinge H14, and the other end of the fourth lower limb link member 134 may be provided at the upper portion of the lower frame part 120 so as to be pivotable by means of the fifth lower limb hinge H15, thereby moving the fourth lower limb hinge H14 along an arc, while also supporting the load applied to the fourth lower limb hinge H14.

Accordingly, when one of the user's two feet exerts a load on the corresponding foot stepping part 110, the first, second, third and fourth lower limb link members 131, 132, 133 and 134 are respectively pivoted with respect to the corresponding hinges together with the foot stepping part 110, such that the fourth lower limb hinge H14 is moved along an arc by the fourth lower limb link member 134, thereby providing a walking trajectory to the foot stepping part 10.

Furthermore, as shown in FIG. 2, the first lower limb hinge H11 may be positioned lower than the fifth lower limb hinge H15. In addition, as shown in FIG. 2, the second lower limb link member 132 may be bent an obtuse angle at the bending part 132*a*.

In addition, as shown in FIGS. 2 and 3, the lower limb link unit 130 may be linked with the belt rotation shaft 122 by means of the lower linking part 170. Accordingly, during walking rehabilitation of the user, like the bicycle pedaling, by the repetitive process of alternating between contacting the treadmill belt 121 by one of the left and right foot stepping parts 110, and then by the other foot stepping part 110, a force may be continuously applied to the lower limb link unit 130, and this force may drive the treadmill belt 121 through the lower linking part 170 and the belt rotation shaft 122. As a result, the user can conveniently use the upper and lower limbs walking rehabilitation device 100 of the present disclosure, without having to force the foot stepping part 110 to contact the treadmill belt 121 to push the treadmill belt 121.

For example, the lower linking part 170 may include a first pulley 161, a third pulley 171, and a lower timing belt 172, as shown in FIG. 3. The first pulley 161 may be provided at one end of the first lower limb link member 131 (e.g., the other end of the first lower limb hinge H11, when one end of the first lower limb hinge H11 is fixed to one end of the first lower limb link member 131), and may include a plurality of teeth on an outer circumferential surface thereof, and the third pulley 171 may be provided at the belt rotation shaft 122 and may include a plurality of teeth on an outer circumferential surface thereof, and the lower timing belt 172 may connect the first pulley 161 and the third pulley 171. Therefore, when the first lower limb link member 131 is rotated with respect to the first lower limb hinge H11, the first pulley 161 is rotated and the third pulley 171 is also rotated by means of the lower timing belt 172 so that the belt rotation shaft 122 can be rotated.

Particularly, in order to synchronize the speed at which the foot stepping part 110 is moved in contact with the treadmill belt 121 and the rotational speed of the treadmill belt 121, the gear ratio of the first pulley 161 and the third pulley 171 may be configured to be 1:1.5. Therefore, when the foot stepping part 110 comes into contact with the contact surface of the treadmill belt 121, the feeling of disparity in the walking speed may be removed.

As another example, although not shown, for the lower linking part, a pulley-belt component having no teeth on the outer circumferential surface may be used, or a plurality of gears connected only by gears without a belt may be used.

As shown in FIGS. 1 to 3, the upper frame part 140 is a component that serves as an upper frame of the upper and lower limbs walking rehabilitation device 100 of the present disclosure, and may be covered by an upper outer cover (140*a* in FIG. 1) for safety. In particular, the upper frame part 140 may be detachably provided by means of a detachment part 145 at an upper end of the lower frame part 120.

Accordingly, the rehabilitation mainly focused on the lower limb may be performed by detaching the upper frame part 140 from the lower frame part 120 by means of the detachment part 145, or the rehabilitation may be performed for both the lower and upper limbs by attaching the upper frame part 140 to the lower frame part 120. Particularly, the burden on the installation space of the device and the cost of purchasing the device can be minimized, because only one upper and lower limbs walking rehabilitation device 100 of the present disclosure can be purchased and used according to the improvement of the degree of disability, that is, the upper frame part 140 may be initially attached to the lower frame part 120 to enable rehabilitation of both the upper and lower limbs, and as the degree of disability improves, the upper frame part 140 may be detached to enable rehabilitation of the lower limb.

Figure 4:
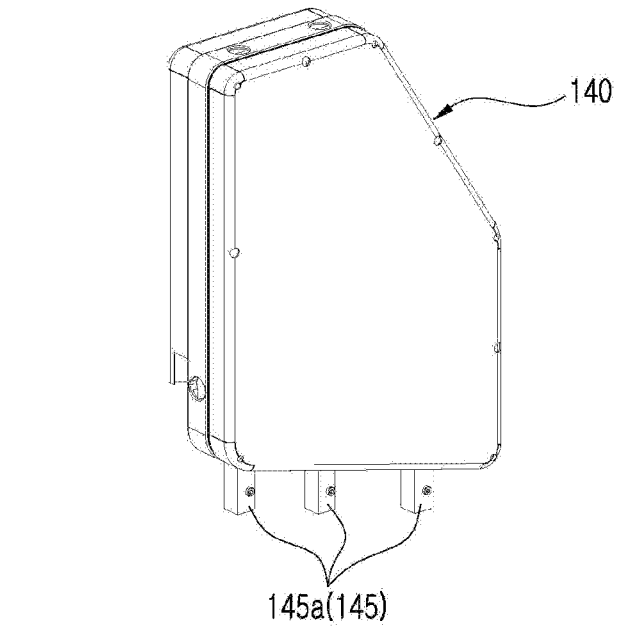
FIG. 4 is a view showing a detachment part for attaching or detaching an upper frame part to or from a lower frame part.
Figure 4:
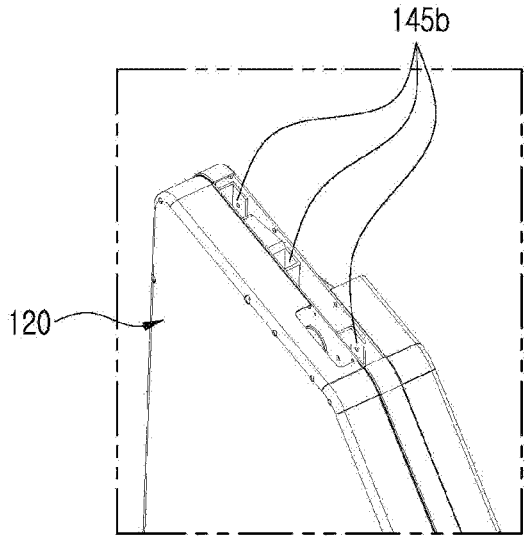

For example, as shown in FIG. 4, the detachment part 145 may include insertion protrusions 145*a* formed in a lower end of the upper frame part 140, and insertion grooves 145*b* for receiving the insertion protrusions 145*a* therein, which are formed in an upper end of the lower frame part 120. Furthermore, although not shown, when the insertion protrusions are inserted into the insertion grooves, the insertion protrusions may be fastened to the lower frame part using separate fastening bolts.

The upper limb link unit 150 is a component for implementing a natural arm swing of the upper limb, and may be provided at the upper frame part 140 as shown in FIG. 2.

For example, as shown in FIG. 2, the upper limb link unit 150 may include a first upper limb link member 151, a second upper limb link member 152, a third upper limb link member 153, a fourth upper limb link member 154, and a handle 155.

The first upper limb link member 151 may have one end provided at the upper frame part 140 so as to be pivotable by means of the first upper limb hinge H21. The second upper limb link member 152 may have one end provided at the other end of the first upper limb link member 151 so as to be pivotable by means of the second upper limb hinge H22. The third upper limb link member 153 may have a central portion provided at the other end of the second upper limb link member 153 so as to be pivotable by means of the third upper limb hinge H23, and the third upper limb link member 153 may have one end provided at the upper portion of the upper frame part 140 so as to be pivotable by means of the fourth upper limb hinge H24, thereby moving the third upper limb hinge H23 along an arc while supporting a load. The fourth upper limb link member 154 may have one end provided at the other end of the third upper limb link member 153 so as to be pivotable by means of the fifth upper limb hinge H25. The handle 155 may be provided at the other end of the fourth upper limb link member 154.

Therefore, the first, second, third and fourth upper limb link members 151, 152, 153 and 154 are pivoted with respect to the hinge respectively by the rotational force transmitted through the lower limb link unit 130 and the upper linking part 160 to be described later, thus providing natural movement for the arm of the occupant. In addition, the upper limb link unit 150 having the same configuration may be provided with a phase difference at the opposite side, thereby providing natural movements for both arms.

Furthermore, as shown in FIG. 2, the first upper limb hinge H21 may be positioned lower than the fourth upper limb hinge H24.

Figure 6:
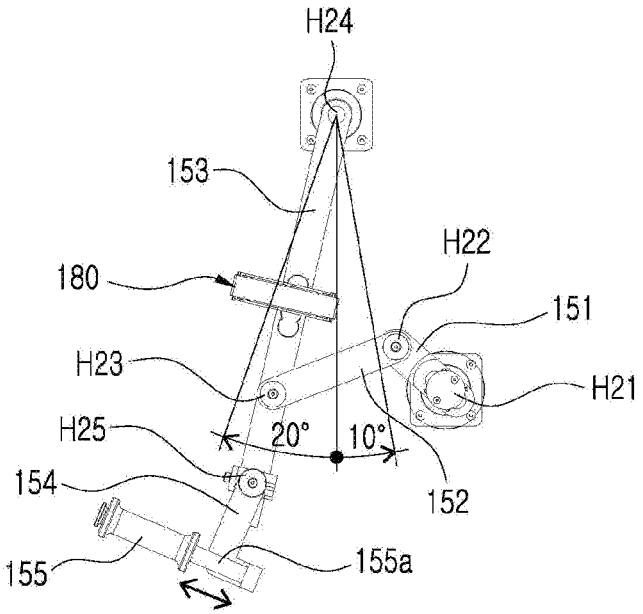
FIG. 6 is a view schematically showing a third upper limb link member swinging from maximum 20 degrees forward to maximum 10 degrees backward.
Figure 6:
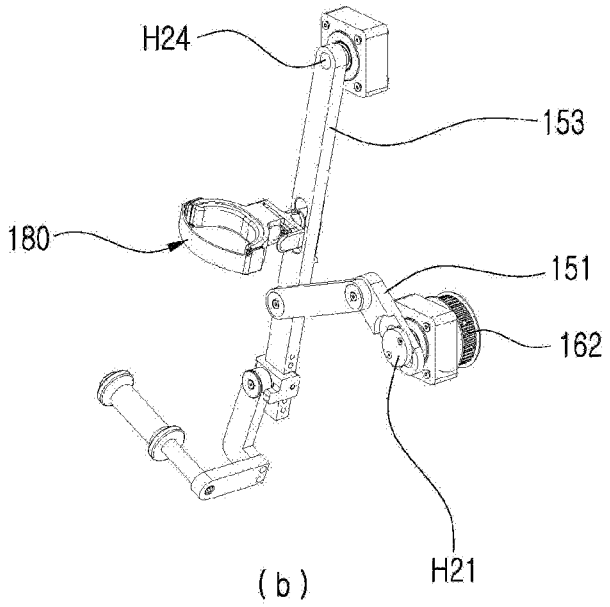

In addition, as shown in FIG. 6, the fourth upper limb hinge H24 may be configured such that the third upper limb link member 153 has a range of swing angles from maximum 20 degrees forward to maximum 10 degrees backward, based on the state where the third upper limb link member 153 is perpendicular to the ground. For example, although not shown, as one example of the mechanism to rotate the fourth upper limb hinge only in the range of the swing angle described above, a locking protrusion may be formed on the fourth upper limb hinge, and a locking jaw may be formed on the hinge hole side of the upper frame part.

Figure 5:
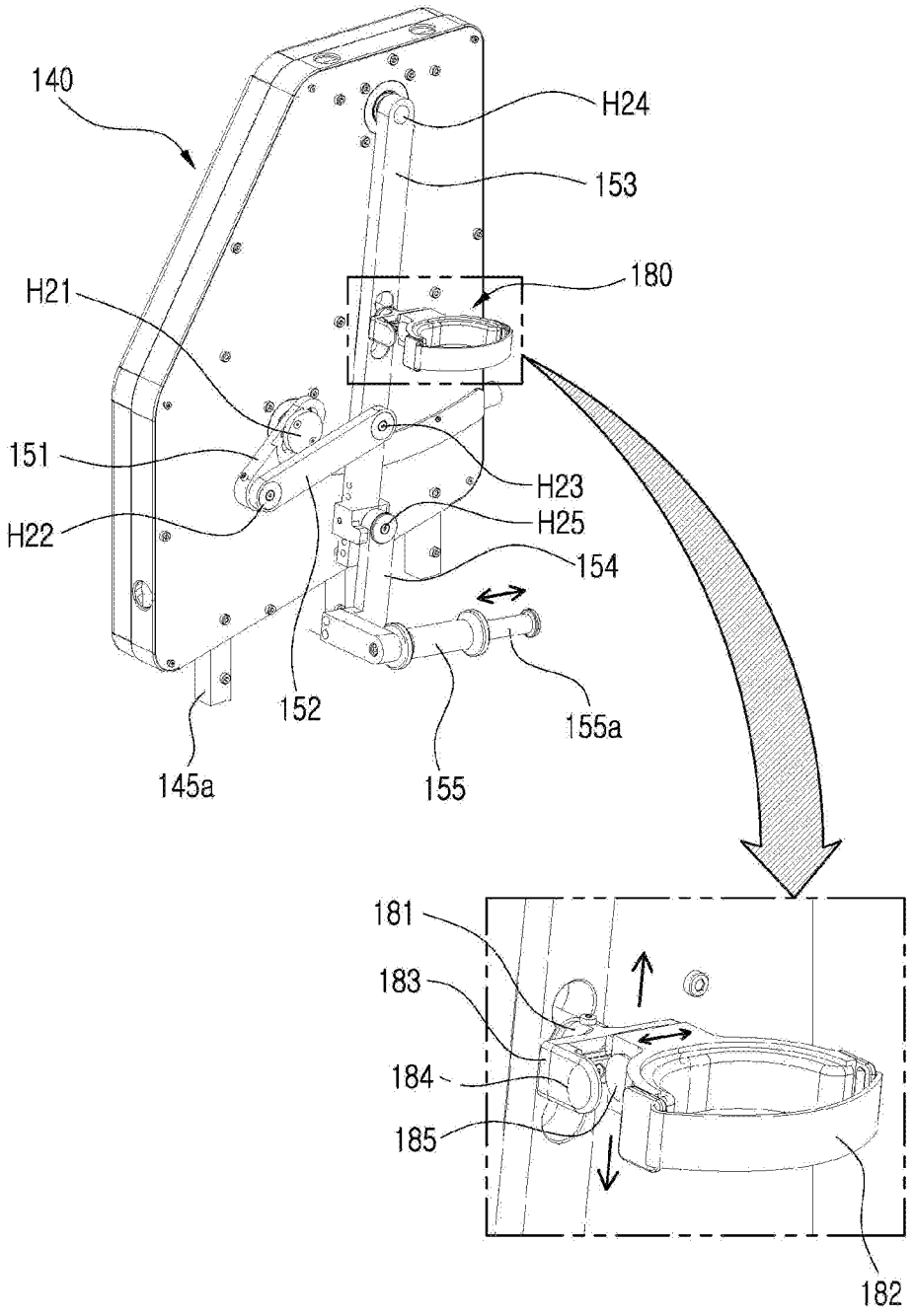
FIG. 5 is a view schematically showing an upper limb link unit and an elbow guide part provided therein.

Further, the handle 155 may be provided at the fourth upper limb link member 154 so as to be slidable forward and backward by means of a slider 155*a*, as shown in FIGS. 5 and 6. The movement trajectory of the wrist joint may be naturally implemented while the occupant's arm is moving.

The upper linking part 160 is a component for linking the upper limb link unit 150 and the lower limb link unit 130. For example, the upper linking part 160 may include a second pulley 162 and an upper timing belt 163 as shown in FIG. 3. The second pulley 162 may be provided at one end of the first upper limb link member 151 (e.g., the other end of the first upper limb hinge H21, when one end of the first upper limb hinge H21 is fixed to one end of the first upper limb link member 151), and may include a plurality of teeth on an outer circumferential surface thereof. The upper timing belt 163 may connect the first pulley 161 mentioned above to the second pulley 162 and the lower linking part 170.

Accordingly, when the first lower limb link member 131 is rotated with respect to the first lower limb hinge H11, the first pulley 161 is rotated and the second pulley 162 is also rotated by means of the upper timing belt 163 so that the first upper limb hinge H21 can be rotated.

In particular, in order to synchronize the speed at which the foot stepping part 110 is moved in contact with the treadmill belt 121 and the rotational speed of the treadmill belt 121, and also to implement a normal walking pattern for the upper and lower limbs, the gear ratio of the first pulley 161, the second pulley 162 and the third pulley 171 may be configured to be 1:1:1.5. Accordingly, when the foot stepping part 110 comes in contact with the contact surface of the treadmill belt 121, the feeling of disparity in the walking speed may be removed and the normal walking pattern for the upper and lower limbs may be implemented.

As another example, although not shown, for the upper linking part, a pulley-belt component having no teeth on the outer circumferential surface may be used, or a plurality of gears connected only by gears without a belt may be used.

In addition, as shown in FIG. 5, the upper and lower limbs walking rehabilitation device 100 according to an embodiment of the present disclosure described above may further include an elbow guide part 180 that guides the movement of the elbow joint of the occupant. As shown in FIG. 5, the elbow guide part 180 may be provided at the third upper limb link member 153 of the upper limb link unit 150.

For example, the elbow guide part 180 may include a height adjustment member 181 and an upper arm holding part 182, as shown in FIG. 5. The height adjustment member 181 may be provided to be movable upward and downward at the third upper limb link member 153, and the upper arm holding part 182 may be provided at the height adjustment member 181 to hold the upper arm of the occupant. Therefore, the occupant's elbow joint may naturally rotate without requiring assistance from a therapist while the occupant's arm is swinging.

Here, the upper arm holding part 182 may be formed of a strip-shaped band or the like that may be adjusted in length according to the thickness of the occupant's upper arm, and Velcro or the like may be used to fasten the band. Further, the height adjustment member 181 may be detached and attached by means of a magnet (not shown).

Furthermore, the elbow guide part 180 may further include a forward and backward movement guide member 183, a first magnet 184, and a second magnet 185, as shown in FIG. 5. The forward and backward movement guide member 183 may be formed of a rail or the like, and may be provided between the upper arm holding part 182 and the height adjustment member 181 to guide the forward and backward movement of the upper arm holding part 182. The first magnet 184 may be provided at the front end and the rear end of the forward and backward movement guide member 183, respectively, and the second magnet 185 may be provided at both sides of the upper arm holding part 182 respectively to correspond to the first magnet 184, and may have the same polarity as the first magnet 184.

Accordingly, while the upper arm holding part 182 is moved forward and backward along the forward and backward movement guide member 183, the first and second magnets 184 and 185, which have the same polarity and are under repulsive force, may naturally act to cushion for the upper arm holding part 182, and as a result, the shock applied to the elbow joint may also be absorbed, thereby improving the safety of the occupant.

In addition, the upper and lower limbs walking rehabilitation device 100 according to an embodiment of the present disclosure described above may further include an upper limb supporting part 190 for supporting the occupant's upper limb, as shown in FIG. 3.

For example, as shown in FIG. 3, the upper limb supporting part 190 may include a harness 191, a hook part 192, a winch 193, and a wire 194. The harness 191 may surround the upper limb and hip of the occupant, and the hook part 192 may be detachably provided at an upper end of the upper frame part 140. The winch 193 may be provided at the lower frame part 120, the wire 194 may be secured by one end with the harness 191 and secured by the other end with the winch through the hook part 192 so as to be pulled or released by the winch 193.

Accordingly, for a particular occupant who has a difficulty in standing upright, the harness 191 may be worn on the occupant and the winch 193 may be rotated in a wind-up direction, according to which the occupant may be easily lifted with the harness 191 as the wire 194 is wound.

The invention claimed is:

1. An upper and lower limbs walking rehabilitation device comprising a foot stepping part, comprising:

a lower frame part;

a lower limb link unit provided between the foot stepping part and the lower frame part and providing a walking trajectory to the foot stepping part;

an upper frame part detachably provided at an upper end of the lower frame part by means of a detachment part;

an upper limb link unit provided at the upper frame part and implementing movement of upper limbs; and an upper linking part for linking the upper limb link unit and the lower limb link unit;

wherein the upper limb link unit includes:

a first upper limb link member having one end of the first upper limb link member provided at the upper frame part so as to be pivotable by a first upper limb hinge;

a second upper limb link member having one end of the second upper limb link member provided at another end of the first upper limb link member so as to be pivotable by a second upper limb hinge;

a third upper limb link member having a central portion provided at another end of the second upper limb link member so as to be pivotable by a third upper limb hinge, and one end of the third upper limb link member provided at an upper part of the upper frame part so as to be pivotable by a fourth upper limb hinge, thereby moving the third upper limb hinge along an arc while supporting a load;

a fourth upper limb link member having one end of the fourth upper limb link member provided at another end of the third upper limb link member so as to be pivotable by a fifth upper limb hinge; and a handle provided at another end of the fourth upper limb link member.

2. The upper and lower limbs walking rehabilitation device according to claim 1, wherein the detachment part includes:

an insertion protrusion provided on a lower end of the upper frame part; and an insertion groove formed in the upper end of the lower frame part to receive the insertion protrusions inserted therein.

3. The upper and lower limbs walking rehabilitation device according to claim 1, wherein the fourth upper limb hinge is configured such that the third upper limb link member has a range of swing angles from a maximum of 20 degrees forward to a maximum of 10 degrees backward, based on a state where the third upper limb link member is perpendicular to a ground.

4. The upper and lower limbs walking rehabilitation device according to claim 1, further comprising an elbow guide part provided at the upper limb link unit to guide a movement of an elbow joint of an occupant, wherein the elbow guide part includes:

a height adjustment member provided to be movable upward and downward at the third upper limb link member; and an upper arm holding part provided at the height adjustment member to hold an upper arm of the occupant.

5. The upper and lower limbs walking rehabilitation device according to claim 4, wherein the elbow guide part includes:

a forward and backward movement guide member provided between the height adjustment member and the upper arm holding part to guide a forward and backward movement of the upper arm holding part;

a first magnet provided at front and rear ends of the forward and backward movement guide member, respectively; and a second magnet provided respectively at both sides of the upper arm holding part to correspond to the first magnet and having a same polarity as the first magnet.

6. The upper and lower limbs walking rehabilitation device according to claim 1, wherein the handle is provided at the fourth upper limb link member so as to be slidable forward and backward by means of a slider.

7. The upper and lower limbs walking rehabilitation device according to claim 1, wherein the lower limb link unit includes a first lower limb link member having one end of the first lower limb link member provided at the lower frame part so as to be pivotable by a first lower limb hinge.

8. The upper and lower limbs walking rehabilitation device according to claim 7, wherein the upper linking part includes:

a first pulley provided at the one end of the first lower limb link member and having a plurality of teeth on an outer circumferential surface thereof;

a second pulley provided at the one end of the first upper limb link member and having a plurality of teeth on an outer circumferential surface thereof; and an upper timing belt connecting the first pulley and the second pulley.

9. The upper and lower limbs walking rehabilitation device according to claim 1, further comprising an upper limb supporting part for supporting an upper limb of an occupant, wherein the upper limb supporting part includes:

a harness configured to surround an upper limb and a hip of the occupant;

a hook part detachably provided at an upper end of the upper frame part;

a winch provided at the lower frame part or the upper frame part; and a wire secured by one end with the harness and secured by another end with the winch through the hook part to be pulled or released by the winch.

* * * * *